US009106006B2

(12) United States Patent
Fukui et al.

(10) Patent No.: US 9,106,006 B2
(45) Date of Patent: Aug. 11, 2015

(54) CONNECTOR HAVING AN ANISOTROPIC CONDUCTIVE FILM

(71) Applicant: Molex Incorporated, Lisle, IL (US)

(72) Inventors: Keiko Fukui, Yamato (JP); Hideo Nagasawa, Naka-gun (JP); Toshihiro Niitsu, Machida (JP); Hirokazu Suzuki, Yamato (JP)

(73) Assignee: Molex Incorporated, Lisle, IL (US)

( * ) Notice: Subject to any disclaimer, the term of this patent is extended or adjusted under 35 U.S.C. 154(b) by 133 days.

(21) Appl. No.: 13/916,077

(22) Filed: Jun. 12, 2013

(65) Prior Publication Data

US 2013/0344719 A1 Dec. 26, 2013

(30) Foreign Application Priority Data

Jun. 12, 2012 (JP) ..... 2012-133170

(51) Int. Cl.

| | |
|---|---|
| ***H01R 4/58*** | (2006.01) |
| ***H01R 12/57*** | (2011.01) |
| ***H01R 4/04*** | (2006.01) |
| ***H01R 43/02*** | (2006.01) |
| *H01R 12/71* | (2011.01) |

(52) U.S. Cl.

CPC ..... *H01R 12/57* (2013.01); *H01R 4/04* (2013.01); *H01R 43/0256* (2013.01); *H01R 12/716* (2013.01)

(58) Field of Classification Search

CPC .. H01R 13/2414; H01R 23/722; H01R 9/096; H01L 23/49827; H05K 3/325

USPC ..... 439/91, 682, 884–886

See application file for complete search history.

(56) References Cited

U.S. PATENT DOCUMENTS

| | | | | | |
|---|---|---|---|---|---|
| 3,922,057 | A | * | 11/1975 | Lemke et al. | 439/844 |
| 4,075,420 | A | * | 2/1978 | Walton | 174/251 |
| 4,170,677 | A | * | 10/1979 | Hutcheson | 428/119 |
| 4,191,445 | A | * | 3/1980 | Deal | 439/843 |
| 4,571,542 | A | * | 2/1986 | Arai | 324/537 |
| 4,617,733 | A | * | 10/1986 | Olson | 29/874 |
| 5,019,944 | A | * | 5/1991 | Ishii et al. | 361/783 |
| 5,145,386 | A | * | 9/1992 | Berg et al. | 439/83 |
| 5,151,037 | A | * | 9/1992 | Range et al. | 439/110 |
| 5,163,837 | A | * | 11/1992 | Rowlette, Sr. | 439/91 |
| 5,360,992 | A | * | 11/1994 | Lowrey et al. | 257/666 |
| 5,414,298 | A | * | 5/1995 | Grube et al. | 257/690 |
| 5,459,500 | A | * | 10/1995 | Morris et al. | 347/50 |
| 5,668,700 | A | * | 9/1997 | Tagusa et al. | 361/779 |

(Continued)

FOREIGN PATENT DOCUMENTS

JP 2007-114710 11/2008

*Primary Examiner* — Abdullah Riyami
*Assistant Examiner* — Vladimir Imas

(57) ABSTRACT

A connector, the connector comprises a tabulate main body and a plurality of tabulate conductors provided on the main body, nested with a pairing connector. Each conductor includes a tabulate terminal located in the main body and engaged with a pairing terminal of the pairing connector, and a rear end outwardly extended to the main body and connected to a terminal connecting part provided on the surface of a mounting part. A face of the rear end on the side of the mounting part is more distant to the surface of the mounting part than a face of the main body on the side of the mounting part. The rear end is connected to the terminal connecting part through an anisotropic conductive film provided between its face on the side of the mounting part and the terminal connecting part.

9 Claims, 11 Drawing Sheets

(56) References Cited

U.S. PATENT DOCUMENTS

| | | | | |
|---|---|---|---|---|
| 5,759,047 | A * | 6/1998 | Brodsky et al. | 439/66 |
| 5,967,841 | A * | 10/1999 | Bianca et al. | 439/590 |
| 6,332,786 | B1 * | 12/2001 | Suga et al. | 439/91 |
| 6,392,306 | B1 * | 5/2002 | Khandros et al. | 257/783 |
| 6,513,235 | B1 * | 2/2003 | Ohsumi et al. | 29/753 |
| 6,575,766 | B1 * | 6/2003 | Xie et al. | 439/70 |
| 6,792,679 | B1 * | 9/2004 | Tai et al. | 29/877 |
| 6,800,000 | B2 * | 10/2004 | Pettersen | 439/886 |
| 6,908,311 | B2 * | 6/2005 | Ono et al. | 439/65 |
| 6,979,208 | B2 * | 12/2005 | Xie et al. | 439/101 |
| 7,309,244 | B2 * | 12/2007 | Yamada et al. | 439/91 |
| 7,435,101 | B2 * | 10/2008 | Yoneta et al. | 439/67 |
| 7,726,984 | B2 * | 6/2010 | Bumb et al. | 439/91 |
| 7,757,929 | B2 * | 7/2010 | Ice et al. | 228/180.21 |
| 7,766,667 | B2 * | 8/2010 | Russell | 439/66 |
| 8,183,155 | B1 * | 5/2012 | Little et al. | 438/682 |
| 8,342,890 | B2 * | 1/2013 | Zhu | 439/682 |
| 8,491,315 | B1 * | 7/2013 | Ramsey et al. | 439/66 |
| 8,525,346 | B2 * | 9/2013 | Rathburn | 257/774 |
| 2004/0087189 | A1 * | 5/2004 | Grant et al. | 439/66 |
| 2011/0294351 | A1 * | 12/2011 | Zhu | 439/638 |

* cited by examiner

CONNECTOR HAVING AN ANISOTROPIC CONDUCTIVE FILM

REFERENCE TO RELATED APPLICATIONS

The Present Disclosure claims priority to prior-filed Japanese Patent Application No. 2012-133170, entitled "Connector," filed on 13 Jun. 2012 with the Japanese Patent Office. The content of the aforementioned Patent Application is incorporated in its entirety herein.

BACKGROUND OF THE PRESENT DISCLOSURE

The Present Disclosure relates, generally, to a connector.

Typically, electronic equipment includes miniaturized, high-performance components. Accordingly, miniaturization and densification of the connector are also required. Therefore, it was proposed that a plurality of conductors patterns be formed on an insulating film substrate, as well as a connector which connected the ends of these conductor patterns to another substrate. An example of this is disclosed in Japanese Patent Application No. 2007-114710, the content of which is hereby incorporated by reference herein in its entirety.

FIG. 11 illustrates a perspective view of a conventional connector. In the Figure, 911 is a negative side base, which is a negative connector base and is mounted on a surface of a circuit substrate (not illustrated). A terminal accommodating opening 954, which runs through the front face and back face of the negative side base 911, is formed on the negative side base 911, and in the terminal accommodating opening 954, a plurality of negative side electrode patterns 951 are provided in a transverse arrangement at predetermined intervals. Each negative side electrode patterns 951 includes a rear end 958 extending to the outside of the negative side base 911, the rear ends 958 being respectively electrically connected to wires of a circuit formed on a surface of the circuit substrate. Furthermore, each negative side electrode patterns 951 includes an inner side opening 954*a* and an arm part 953 which delimits the periphery of the inner side opening 954*a*. Moreover, the inner side opening 954*a* includes a narrow portion with a narrower width and wide portions with wider widths formed in the vicinity of both ends of the narrow portion.

Additionally, during the nesting process, the positive connector (not illustrated) is forced to move with respect to the negative connector in the thickness direction (a direction perpendicular to the Figure) of the negative connector and carries out nesting. At the same time, a convex positive side electrode (not illustrated) projecting from the surface of the negative connector protuberantly enters the wide portions of the inner side opening 954*a*. Then, when the positive connector is forced to move with respect to negative connector in the longitudinal direction of the Figure, the positive side electrode protuberance moves within the narrow portion.

However, in the conventional connector, since the rear end 958 is welded on circuit wires formed on the surface of the substrate by reflow soldering, for example, when electronic components with low heat resistance are mounted on the substrate, it becomes difficult to use the connector. Further, although a cohesive conductive film such as an anisotropic conductive film can also be used (in lieu of soldering) for connecting the rear end 958 to wires, it is difficult to simultaneously and uniformly apply a pressing force and to connect the plurality of rear ends 958 by pressure.

SUMMARY OF THE PRESENT DISCLOSURE

An object of the Present Disclosure is to provide a connector to solve the aforementioned disadvantages of the conventional connector. Accordingly, the connector is configured as a face of the rear end outwardly extending to the main body on the side of the mounting part more distant to the surface of the mounting part than a face of the main body on the side of the mounting part, and includes an anisotropic conductive film provided between a face of the rear end on the side of the mounting part and the terminal connecting part provided on the surface of the mounting part. It is possible to uniformly push the anisotropic conductive film and to reliably and easily connect the rear ends of the plurality of conductors to wires of the substrate. Accordingly, miniaturization, flattening and reliability are enhanced.

Therefore, in the connector of the Present Disclosure, a connector has a tabulate main body and a plurality of tabulate conductors provided on the main body, and is nested with a pairing connector. Each conductor includes a tabulate terminal located in the main body and engaged with a pairing terminal of the pairing connector, and a rear end outwardly extended to the main body and connected to a terminal connecting part provided on the surface of a mounting part. A face of the rear end on the side of the mounting part is more distant to the surface of the mounting part than a face of the main body on the side of the mounting part. The rear end is connected to the terminal connecting part through an anisotropic conductive film provided between the face on the side of the mounting part and the terminal connecting part.

Further, in another connector of the Present Disclosure, the pairing terminal protrudes. The tabulate terminal is a tabulate part located in a terminal accommodating opening, and includes a pair of contacting arm parts. When the protruded terminal accommodated in the terminal accommodating opening makes relative movement within the terminal accommodating opening, the pair of contacting arm parts elastically deforms to clamp the protruded terminal.

Further, in yet another connector of the Present Disclosure, the main body includes an enhanced layer provided on the conductor at the side of mounting part. The pairing connector is nested with the connector, and a front terminal of the protruded terminal accommodated in the terminal accommodating opening is more distant to the surface of the mounting part than a face of the main body on the side of the mounting part.

Further, in yet another connector of the Present Disclosure, the connector includes a tabulate framework provided on the conductor at the opposite side of the mounting part. A portion of the framework covers the rear end on the opposite side of the mounting part, a face of the framework on the opposite side of the mounting part becomes a pressured face bearing the pressure force of a force-exerting part, and the force-exerting part is used to exert pressure on the anisotropic conductive film.

Further, in yet another connector of the Present Disclosure, the connector further includes a tabulate framework provided on the conductor at the opposite side of the mounting part. The framework includes a peristome corresponding to the rear end, so that a portion of a force-exerting part exerting pressure on the anisotropic conductive film can enter into the peristome.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Referring to FIGS. 1-4, 1 is, in this embodiment, a positive connector as a pairing connector, and 101 is a negative connector as a connector. Positive connector 1 and negative connector 101 are individually mounted on a mounting part (not illustrated), and are nested with each other to be electrically connected. In addition, positive connector 1 and negative connector 101 are respectively surface-mounted on a surface of a first substrate (not illustrated) as a mounting part and surface 191*a* of later-mentioned second substrate 191.

Figure 1:
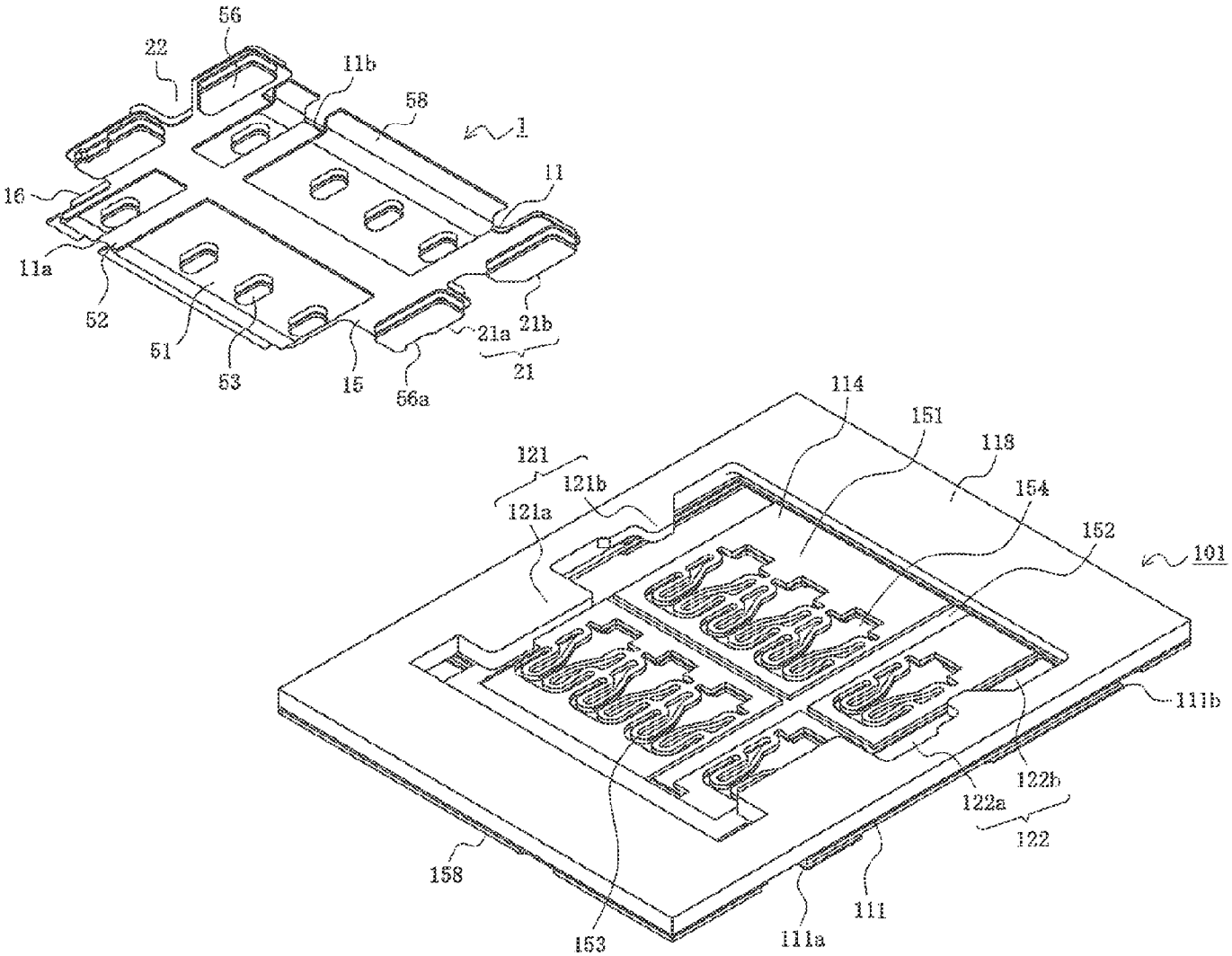
FIG. 1 is a perspective view showing a state of a nesting face of a positive connector obliquely opposite to a nesting face of a negative connector in one embodiment of the Present Disclosure.
Figure 2:
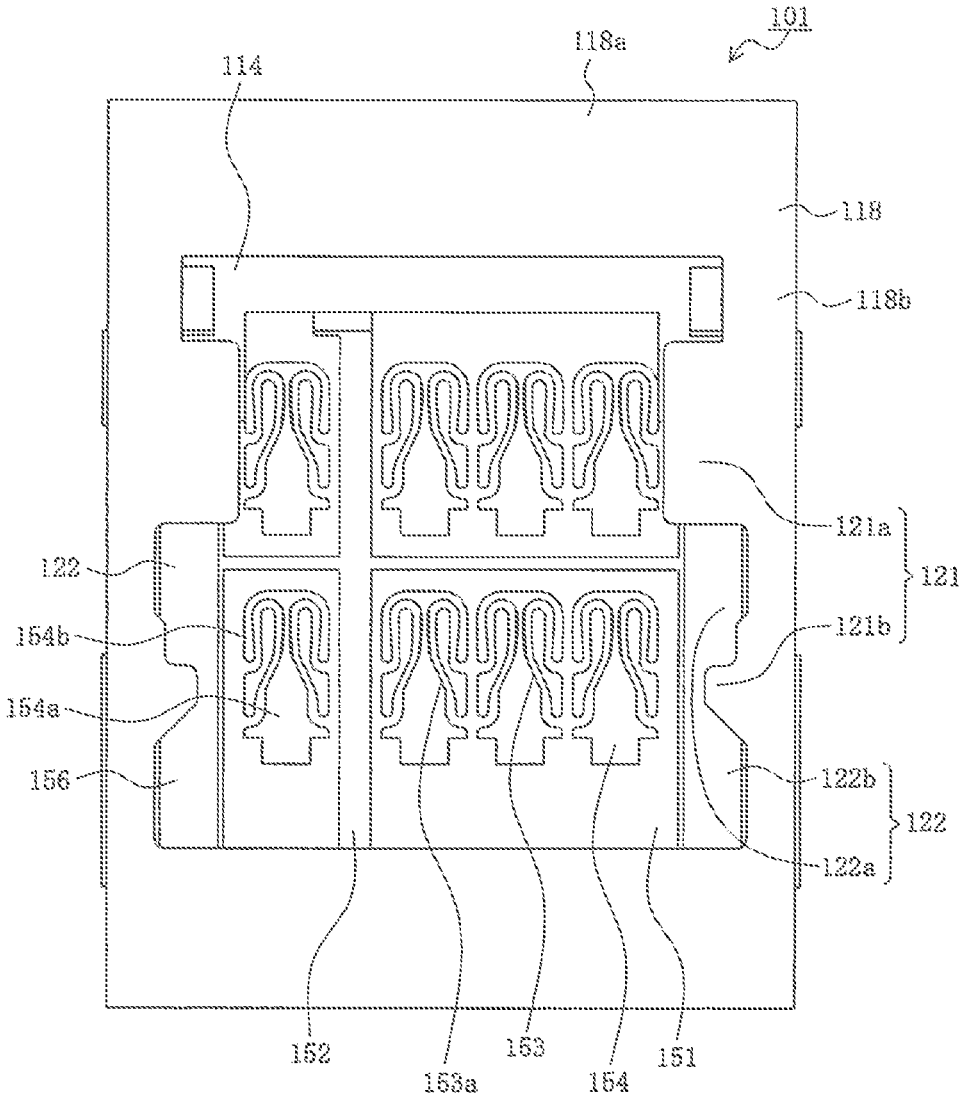
FIG. 2 is a top view showing the negative connector of FIG. 1.

Additionally, positive connector 1 has tabulate main body 11 whose flat shape is rectangular. Beginning from the side of the mounting face (i.e., the opposite side of the face as shown in FIG. 1), main body 11 has a flat lamina part—used as enhanced layer 16 of the plate-shaped enhanced plate part, base film 15 having an elongated strip-shaped insulating lamina part—used as a plate-shaped first substrate part and as a positive substrate part, and conductor pattern 51 provided on one face (i.e., a face on the side of nesting face) of base film 15—used as a tabulate positive conductor. In addition, the size of main body 11 in thickness direction is about 0.3-0.5 mm, but such size can be suitably changed.

Base film 15 is made of, for example, resin; however its material can be of any kind of material quality in case of materials with insulativity. Furthermore, on another face (a face on the side of mounting face) of base film 15, there is provided with the flat lamina part used as enhanced layer 16 of plate-shaped enhanced plate part. Enhanced layer 16 is made of, for example, metal; however its material could be resin, and also could be a composite material including glass fiber or carbon fiber, and could be of any kind of material quality.

Additionally, conductor patterns 51, for example, are formed by means of applying processes, such as etching, for patterning on copper foil with the thickness of several dozens of μm, which is previously attached on one face of base film 15. Conductor patterns 51 extend in front-back direction of positive connector 1 (main body 11), and are arranged parallel to each other in a direction of the width of positive connector 1 (main body 11), and adjacent conductor patterns 51 are separated by pattern separating space 52.

Each conductor pattern 51 comprises conductors (i.e., positive conductors) functioning as multiple lines of wires arranged parallel, and includes protruded terminal 53 which exposes from the nesting face of main body 11 and functions as a pairing terminal (i.e., positive terminal). In addition, as shown in the Figures, although conductor patterns 51 are divided into a wide pattern formed with three protruded terminals 53 as well as a narrow pattern formed with protruded terminal 53, and are configured as being composed of the wide pattern and the narrow pattern along a row front end 11*a* and back end 11*b* of each main body 11, number, interval and other arrangement means of conductor pattern 51 and protruded terminal 53 are not limited to the examples shown and can be altered.

Each protruded terminal 53 includes a part protruding from surface of conductor pattern 51, and, for example, is integrated with conductor pattern 51 by etching means such as photolithography. In addition, the height of protruded terminal 53 is about 0.1-0.3 mm, and can properly change. Furthermore, as shown, the transverse cross sections of the front terminal and the shaft of protruded terminal 53 preferably has a shape having a bigger size in front-back direction and a smaller size in left-right direction. Although preferably transverse cross section of the front terminal is bigger than that of the shaft, the shape can properly change.

Moreover, each conductor pattern 51 includes rear end 58 extending in the front-back direction of main body 11. Each rear end 58 outwardly protrudes from front end 11*a* and back end 11*b* of main body 11, and is connected to a terminal connecting part (i.e., surface of wires or connecting pad conducting to wires) formed on the surface of the first substrate (not illustrated). Thus, positive connector 1 is mounted on the first substrate, and conductor pattern 51 and protruded terminal 53 come into a state of electrically connecting to wires of the first substrate.

On edges of main body 11 on both the left and right side, there is formed ear part 21 as a positive nesting lock part which outwardly extends in width direction. Moreover, although ear part 21 includes front ear part 21*a* and back ear part 21*b*, and accommodating groove 22 is formed between front ear part 21*a* and back ear part 21*b*, the number and configuration can properly change as required. Furthermore, on nesting faces of front ear part 21*a* and back ear part 21*b*, there are provided auxiliary accessories 56. Auxiliary accessory 56, together with conductor pattern 51, are formed by means of applying processes, such as etching, for the purpose of patterning on copper foil with the thickness of several dozens of μm, previously attached on one face of base film 15. Moreover, side edge of auxiliary accessory 56 of front ear part 21*a* is formed with engaging groove 56*a*.

Figure 4:
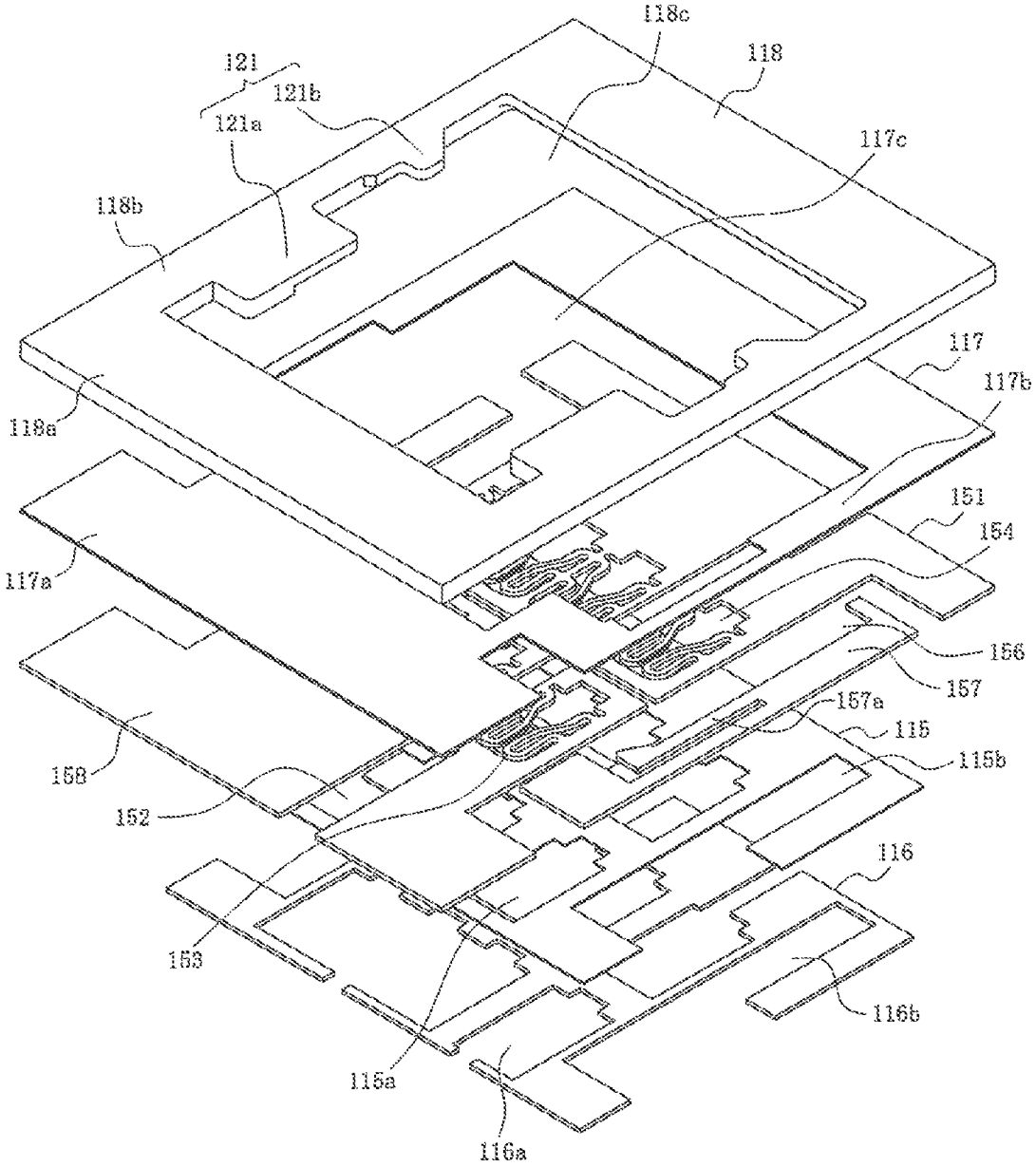
FIG. 4 is a layer-structure exploded view showing the negative connector of FIG. 1.

Furthermore, although negative connector 101 in this embodiment is a tabulate flat connector which on the whole has a shape of rectangle, and its size in width direction is about 0.3-0.5 mm, its size can properly change. As shown in FIG. 4, negative connector 101 is a tabulate part of a lay-structure formed by sequentially stacking enhanced layer 116, base film 115, conductor pattern 151 as tabulate negative conductor, cover film 117, and enhanced frame layer 118 as framework, from the side of mounting face (opposite side of the face as shown in FIG. 1). Base film 115 is made of, for example, resin; however its material can be of any kind of insulative material. Furthermore, enhanced layer 116 is made of, for example, metal; however its material could be resin, and also could be a composite material including glass fiber or carbon fiber, and could be of any kind of material quality. Additionally, conductor patterns 151, for example, may be formed by means of applying processes, for the purpose of patterning on copper foil with the thickness of several dozens of μm, previously attached on one face of base film 15; conductor patterns 151 extend in front-back direction of negative connector 101 (main body 11), and are arranged parallel to each other in the direction of the width of negative connector 101, and adjacent conductor patterns 151 are separated by pattern separating space 152. In addition, conductor pattern 151 may be formed by punching a metal plate attached with base film 115.

Each conductor pattern 151 comprises conductors (i.e., positive conductors) functioning as multiple parallel lines of wires, and includes a tabulate terminal (i.e., accommodating terminal 153 functioning as negative terminal) which exposes from connecting groove 114 in nesting face of main body 111. In addition, as shown, although conductor patterns 151 are divided into a wide pattern formed with three accommodating terminals 153, as well as a narrow pattern formed with protruded terminal 153, and each row of main body 111 on side of front end 111*a* and side of back end 111*b* are composed of the wide pattern and the narrow pattern, the number, interval and other arrangement means of conductor patterns 151 and accommodating terminal 153 are not limited to the examples shown and can be altered.

Each accommodating terminal 153 is accommodated in terminal accommodating opening 154, which runs through conductor pattern 151 in thickness direction. Typically, patterns left after patterning conductor pattern 151 become accommodating terminals 153, and the removed parts of materials around accommodating terminal 153 become terminal accommodating opening 154. Therefore, the thickness of accommodating terminal 153 is equal to that of conductor pattern 151. Moreover, each accommodating terminal 153 includes pair of contacting arm parts 153*a*, whose bottom part is connected to the periphery portion of accommodating terminal 153 in conductor pattern 151 (i.e., edge of terminal accommodating opening 154). Contacting arm part 153*a* possesses flexibility, and can elastically deform along the width direction of negative connector 101. Furthermore, terminal accommodating opening 154 includes inner side opening 154*a* inside accommodating terminal 153 and outside opening 154*b* outside accommodating terminal 153. Inner side opening 154*a* is the portion of protruded terminal 53 which gets in and is accommodated when accommodating terminal 153 is nested with protruded terminal 53 of positive connector 1, and outside opening 154*b* is the portion allowing contacting arm part 153*a* to deform.

In addition, inner side opening 154*a* has a large area, and typically, its width size is larger than the width size of the front terminal of protruded terminal 53. Furthermore, its size in the up-down direction is also larger than the size in the up-down direction of the front terminal of protruded terminal 53. Therefore, protruded terminal 53 can successfully enter into inner side opening 154*a*. On the other hand, the gap between opposite-arranged portions of a pair of contacting arm parts 153*a* is a space with small width, and typically, its width size is smaller than the width size of the shaft of protruded terminal 53. Therefore, when protruded terminal 53, accommodated in the inner side opening 154*a*, makes relative movements within the gap between opposite-arranged portions of contacting arm part 153*a*, since the gap between opposite-arranged portions of contacting arm part 153*a* is against to side face of the shaft of protruded terminal 53 and is extended, with elasticity of contacting arm part 153*a*, opposite-arranged portions of contacting arm part 153*a* become a state of being pushed by the side face of the shaft of protruded terminal 53. That is, pair of contacting arm parts 153*a* elastically clamps protruded terminal 53 from both sides.

Furthermore, inner side opening 154*a* has a shape as, when approaching the gap between opposite-arranged portions of the contacting arm part 153*a*, the width size gradually reduces. That is, opposite-arranged contacting arm parts 153*a* are shaped as inclined taper. Therefore, protruded terminal 53 can successfully enter into the gap between opposite-arranged portions of opposite-arranged contacting arm parts 153*a*.

In addition, the left side and right side of conductor pattern 151 are provided with negative auxiliary accessories 157. Each negative auxiliary accessory 157 is separated from conductor pattern 151, and spaced between negative auxiliary accessory 157 and conductor pattern 151 is engaging space part 156, which accommodates auxiliary accessory 56 of positive connector 1. In addition, engaging stop arm 157*a* is formed on negative auxiliary accessory 157, and engaging stop arm 157*a* is an elastic part with a shape of cantilever, and its protruding portion at a front end is engaged with engaging groove 56*a* of auxiliary accessory 56.

Additionally, individual conductor pattern 151 includes rear end 158, which extends towards outside of main body 111 along front-back direction. Each rear end 158 is connected to, through later-mentioned Anisotropic Conductive Film (ACF) 161, later-mentioned terminal connecting part 193 formed on surface 191*a* of second substrate 191, i.e., the surface of a wire or the connecting pad conducting to wires. Thus, negative connector 101 is mounted on second substrate 191, and conductor pattern 151 and accommodating terminal 153 come into a state of electrically connecting to wires of second substrate 191.

Figure 3:
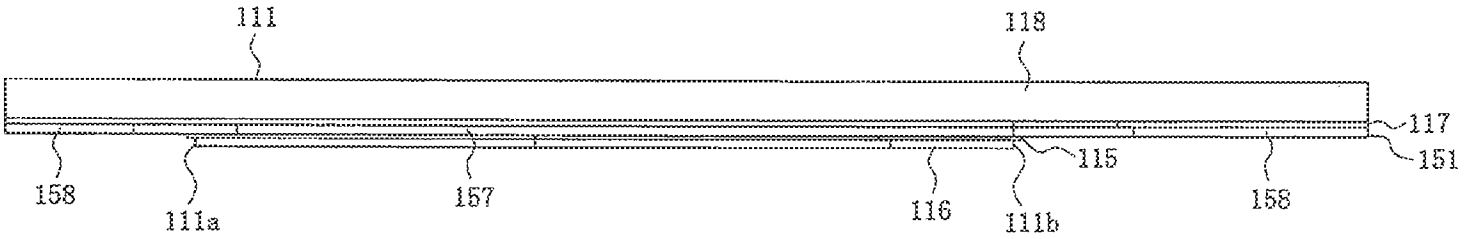
FIG. 3 is a side view showing the negative connector of FIG. 1.

In addition, as shown in FIG. 3, although rear end 158 does not protrude outwardly from cover film 117 and front end and back end of enhanced frame layer 118, it protrudes from front end 111*a* and back end 111*b* of main body, i.e., outwardly from enhanced layer 116 and front end and back end of base film 115. Therefore, face of rear end 158 on the side of second substrate 191 (at the bottom of FIG. 3) is not covered by enhanced layer 116 and base film 115 to be exposed.

Enhanced layer 116 is made of, for example, metal; however its material could be resin, and also could be a composite material, and could be of any kind of material quality. Furthermore, base film 115 is made of, for example, resin; however its material can be of any kind of insulative material. Moreover, although profile sizes of enhanced layer 116 and base film 115 are slightly bigger than connecting groove 114, such profile sizes may be smaller than the profile size of enhanced frame layer 118. Especially, sizes in front-back direction of enhanced layer 116 and base film 115 may be significantly smaller than the profile size of enhanced frame layer 118. Therefore, in a top view, enhanced layer 116 and base film 115 almost will not exceed outside the enhanced frame layer 118, especially in the front-back direction. In addition, on enhanced layer 116 and base film 115, at positions corresponding to terminal accommodating opening 154 of conductor pattern 151, and corresponding to engaging space part 156 between negative auxiliary accessory 157 and conductor pattern 151, there are formed terminal corresponding opening 116*a* and 115*a* and engaging space corresponding openings 116*b* and 115*b*.

Furthermore, enhanced frame layer 118 is a tabulate part made of, for example, metal, and with a surface shape substantially a rectangle ring. In addition, its material could be resin, a composite material, or any kind of material quality. Moreover, enhanced frame layer 118 includes a pair of transverse frame parts 118*a* extending along width direction of negative connector 101 (transverse direction of FIG. 2), and a pair of longitudinal frame parts 118*b* extending along front-back direction of negative connector 101 (longitudinal direction of FIG. 3) and connecting to front and back ends of transverse frame part 118*a*. Furthermore, connecting opening 118*c* is formed on enhanced frame layer 118. Connecting opening 118*c* is an opening running through enhanced frame layer 118 in the thickness direction, and with connecting groove 114, delimited by transverse frame part 118*a* and longitudinal frame part 118*b*.

Moreover, the cover film 117 is made of, for example, resin; however its material can be of any kind of insulative material. Moreover, cover film 117 includes transverse frame part 117*a*, longitudinal frame part 117*b* and connecting opening 117*c*, substantially corresponding to transverse frame part 118*a* and longitudinal frame part 118*b* of enhanced frame layer 118 as well as connecting opening 118*c*. Transverse frame part 117*a* of cover film 117 and transverse frame part 118*a* of enhanced frame layer 118 extend to front end 111*a* and back end 111*b* of main body 111. Therefore, face of rear end 158 on the opposite side of second substrate 191 (upper portion of FIG. 3) is covered by transverse frame part 117*a* as a portion of the cover film 117, and transverse frame part 118*a* as a portion of enhanced frame layer 118.

In addition, on longitudinal frame part 118*b* of enhanced frame layer 118, there is formed ear part 121 as a negative nesting lock part extending inwardly along width direction, and accommodating groove 122 is formed adjacent to ear part 121. Moreover, ear part 121 includes front ear part 121*a* and back ear part 121*b*, accommodating groove 122 includes front accommodating groove 122*a* and back accommodating groove 122*b*. In addition, number and configuration of ear part 121 and accommodating groove 122 can properly change to be corresponding to ear part 21 of positive connector 1.

Figure 5:
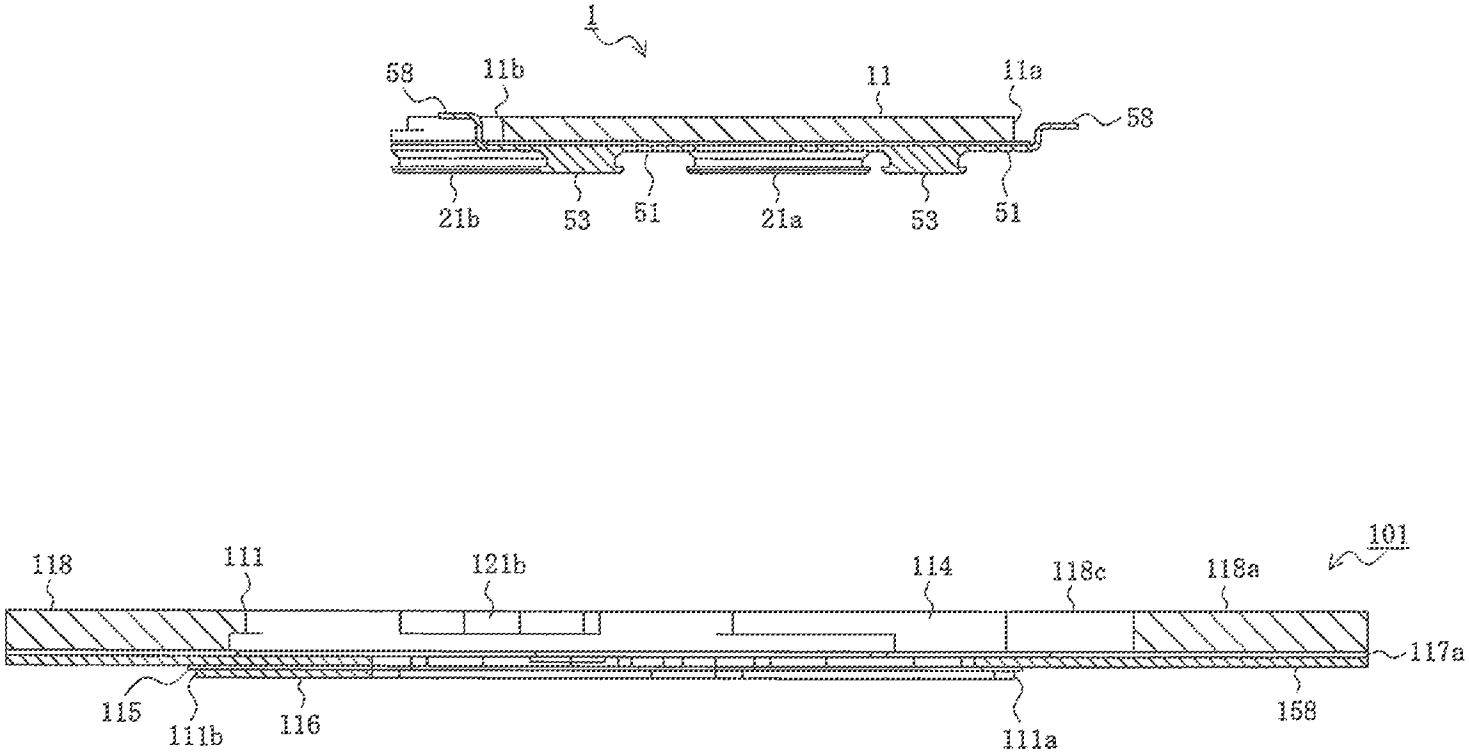
FIG. 5 is a side sectional view showing the nesting process of the positive connector and the negative connector of FIG. 1.
Figure 6A:
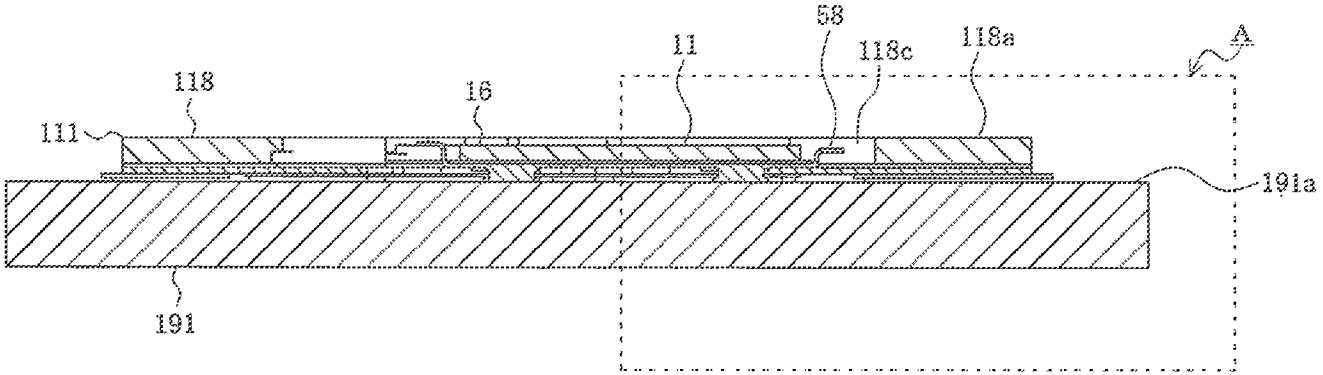
FIG. 6 is a side sectional view showing the state when the positive connector and the negative connector of FIG. 1 have already been nested, wherein FIG. 6(*a*) is an overall view and FIG. 6(*b*) is an enlarged view of Section A in FIG. 6(*a*)
Figure 6B:
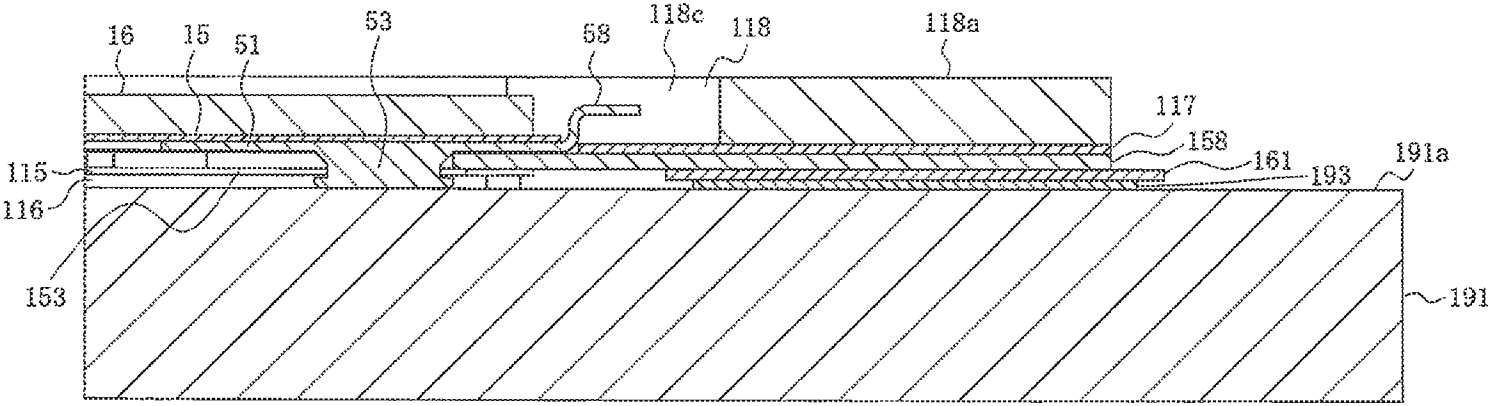

FIGS. 5-6 illustrate the operation of nesting positive connector 1 of the structure and negative connector 101. Referring to the Figures, positive connector 1 is previously surface-mounted onto first substrate by for example welding rear end 58 of conductor pattern 51, to connect to terminal connecting part formed on surface of first substrate (not illustrated).

Furthermore, as shown in FIG. 6, negative connector 101 is surface-mounted onto second substrate 191 by using anisotropic conductive film 161 and rear end 158 of conductor pattern 151 to connect to terminal connecting part 193 formed on the surface of second substrate 19. In addition, anisotropic conductive film 161 is sheet-shaped or film-shaped part manufactured by mixing conductive filler into thermosetting resin, and is heated and arranged between a pair of conductive parts, to adhere to between the conductive parts and make it conductive.

Therefore, when negative connector 101 is surface-mounted on second substrate 191, first of all, when anisotropic conductive film 161 is arranged between rear end 158 and terminal connecting part 193, negative connector 101 is carried onto predetermined position on surface 191*a* of second substrate 191. In addition, for example, the side at front end 111*a* and back end 111*b* of main body 111 is respectively provided with a piece of anisotropic conductive film 161. For example, two pieces of anisotropic conductive films 161 with lengths comparable to the width direction of main body 111 and with widths comparable to size of front-back direction of transverse frame part 118*a* of enhanced frame layer 118 are previously prepared. Then, individual anisotropic conductive film 161 is arranged between a face on the side of second substrate 191 of rear end 158 on front end 111*a* side of main body 111 and terminal connecting part 193, and between a face on the side of second substrate 191 of rear end 158 on back end 111*b* side of main body 111 and terminal connecting part 193.

Then, a pushing face of the pressure head of a heat press device heated by a heating device is pushed against a face of enhanced frame layer 118 on the side of nesting face, and enhanced frame layer 118 is pushed towards second substrate 191. Thus, since anisotropic conductive film 161 is heated and pressed through enhanced frame layer 118, rear end 158 and terminal connecting part 193 are adhered and conductive. In addition, it is known that, since the heating temperature in reflow soldering is usually 220-60° C., while the heating temperature of anisotropic conductive film 161 is 180-200° C., compared with welding, by using anisotropic conductive film 161, a lower temperature can be applied to connect rear end 158 and terminal connecting part 193.

Furthermore, the pushing face of the pressure head is, for example, rectangular, and has sizes in width direction and in front-back direction larger than sizes in width direction and in front-back direction of enhanced frame layer 118. Thus, it is possible to uniformly push enhanced frame layer 118. Further, it is possible to uniformly push anisotropic conductive film 161.

In addition, as shown in FIG. 3, rear end 158 together with cover film 117 and enhanced frame layer 118 protrude outwardly from front end 111*a* and back end 111*b* of main body; i.e., enhanced layer 116 and front end and back end of base film 115. Moreover, the face of rear end 158 on the side of second substrate 191 is more distant to surface 191*a* of second substrate 191 than the face of main body 111 on the side of second substrate 191. Therefore, when negative connector 101 is carried onto surface 191*a* of second substrate 191, so that when the face of enhanced layer 116 on the side of mounting face is put against surface 191*a* of second substrate 191, the face of rear end 158 on the side of second substrate 191 is distant from surface 191*a* of second substrate 191, such distance being comparable to the thicknesses of enhanced layer 116 and base film 115. Thus, even if the face of terminal connecting part 193 slightly projects from surface 191*a* of second substrate 191, when carrying negative connector 101 onto surface 191*a* of second substrate 191, a margin is sufficiently maintained so that anisotropic conductive film 161 can be located between rear end 158 and terminal connecting part 193.

Furthermore, when pressing anisotropic conductive film 161, since enhanced layer 116 and base film 115 function as spacers, the distance between rear end 158 and terminal connecting part 193 is kept fixed. Therefore, anisotropic conductive film 161 will not be excessively compressed due to pressure, and is compressed at a fixed amount of compression, thus the predetermined conductive state caused by conductive filler can always be achieved, and non-resistance of rear end 158 and terminal connecting part 193 is stable. Furthermore, since anisotropic conductive film 161 will not be excessively compressed, the adhesive will not leak out from anisotropic conductive film 161 and pollute the environment.

Additionally, since rear end 158 is a wide sheet-shaped part with large area, and transverse frame part 118*a*, as a part of enhanced frame layer 118 located on rear end 158, is also a rectangular plate part with large area, a pressure force, through transverse frame part 118*a* and rear end 158, is uniformly applied to anisotropic conductive film 161 located below rear end 158. Additionally, since transverse frame part 118*a* on the side of front end 111*a* and transverse frame part 118*a* on the side of back end 111*b* of main body 111 is connected by longitudinal frame part 118*b* so as to be integrated, a pressure force, through transverse frame part 118*a* on the side of front end 111*a* and transverse frame part 118*a* on the side of back end 111*b*, is uniformly applied to anisotropic conductive film 161 carried at the side of front end 111 and anisotropic conductive film 161 carried at the side of back end 111*b* of main body 111.

Additionally, since rear end 158 does not protrude from enhanced frame layer 118 and is located below the transverse frame part 118*a*, it is not necessary that the pushing face of the pressure head have a complex shape for pushing rear end 158, as long as it is a flat face that can push enhanced frame layer 118. Therefore, the cost for processing pressure head is not needed. In addition, in this embodiment, although descriptions are made in a case that rear end 58 of positive connector 1 is used as a part that is connected to terminal connecting part formed on surface of first substrate by means such as welding, similar to rear end 158 of negative connector 101, modifications can made so that anisotropic conductive film 161 is used to make connection. Moreover, when nesting positive connector 1 and negative connector 101, first of all, as shown in FIG. 5, operators put the nesting face of positive connector 1 and of negative connector 101 into an opposite-arranged state. In addition, as shown in FIG. 5, for purpose of convenience, illustration of first substrate and second substrate 191 is omitted.

Then, positive connector 1 descends relative to negative connector 101; i.e., moves in an engaging direction, forcing the nesting face of positive connector 1 to be opposite-arranged with, against and approach the nesting face of negative connector 101, so that positive connector 1 is accommodated in connecting groove 114 of negative connector 101. Thus, ear part 21 of positive connector 1 enters into corresponding accommodating groove 122 of negative connector 101. Furthermore, auxiliary accessory 56 enters into engaging space part 156. Additionally, each protruded terminal 53 enters into inner side opening 154*a* at inner side of accommodating terminal 153.

Then, positive connector 1 slides upward relative to negative connector 101 in a locking direction; i.e., in a state that the surface of positive connector 1 is put against or approaches the surface of negative connector 101, positive connector 1 slides forward (the direction to front end 111*a*) relative to negative connector 101. In such case, individual protruded terminal 53 enters into inner side opening 154*a* at the inner side of corresponding accommodating terminal 153, slides and is guided in a state that left and right ear parts 21 and auxiliary accessory 56 enter into left and right accommodating grooves 122 and engaging space part 156. Thus, the posture of positive connector 1 relative to negative connector 101 will not be tousled.

Additionally, as shown in FIG. 6, when positive connector 1 is completely engaged with negative connector 101, left and right ear parts 21 in positive connector 1 are engaged with left and right ear parts 121 in negative connector 101. Specifically, at least a part of front ear part 21*a* and back ear part 21*b* of positive connector 1 reaches underneath of corresponding front ear part 121*a* and back ear part 121*b* of negative connector 101 and gets engaged. Furthermore, a projected part of negative connector 101 formed on engaging stop arm 157*a* of negative auxiliary accessory 157 is engaged with engaging groove 56*a* of auxiliary accessory 56 of positive connector 1. Thus, the nesting state of positive connector 1 and negative connector 101 is locked. In addition, in FIG. 6, for purpose of convenience, illustration of first substrate is omitted.

Furthermore, when positive connector 1 slides relative to negative connector 101 in the locking direction (i.e., forward), protruded terminal 53 entered in inner side opening 154*a* at the inner side of accommodating terminal 153 moves relative to inner side opening 154*a*, and enters into the gap between opposite-arranged contacting arm parts 153*a*. Thus, since the gap between contacting arm parts 153*a* is put against the side face of the shaft of protruded terminal 53 and is extended due to the elasticity of contacting arm part 153*a*, contacting arm part 153*a* is pushed by the side face of the shaft of protruded terminal 53. That is to say, the pair of contacting arm parts 153*a* elastically clamps the shaft of protruded terminal 53 from both sides. Then, this helps contacting arm part 153*a* to clamp the shaft of protruded terminal 53, and to keep the nested state.

Additionally, accommodating terminal 153 includes a thin wall, as shown in FIG. 6, since the thickness of accommodating terminal 153 is smaller than the height of protruded terminal 53, even if dimensional error (tolerance), inclination of the shape of individual portions and so on causes malposition in nesting direction of positive connector 1 and negative connector 101 between protruded terminal 53 and accommodating terminal 153, all of protruded terminal 53 can still reliably enter into inner side opening 154*a* on the inner side of corresponding accommodating terminal 153, and the shaft of protruded terminal 53 can reliably contact contacting arm part 153*a*. Furthermore, since enhanced layer 116 and base film 115 are provided at the side of second substrate 191 of conductor pattern 151, the face of accommodating terminal 153 on the side of second substrate 191 is distant from surface 191*a* of second substrate 191 by at least a certain distance, and such distance is comparable to thicknesses of enhanced layer 116 and base film 115. Therefore, even if the front terminal of protruded terminal 53 protrudes from face of accommodating terminal 153 at the side of second substrate 191, the front terminal of protruded terminal 53 still will not be put against surface 191*a* of second substrate 191 to cause damage on such front face 191*a*, and will not unnecessarily conduct to wires and the like formed on the front face 191*a*. In addition, as FIG. 6 schematically illustrates, it is should be noted that relationship between the front terminal of protruded terminal 53 and surface 191*a* of second substrate 191 is not definitely clear. In addition, as for operations of detaching the nesting between positive connector 1 and negative connector 101, they are just opposite operations as operations for nesting positive connector 1 and negative connector 101, thus description thereof is omitted.

In this way, in this embodiment, the connector is negative connector 101 which has tabulate main body 111, and a plurality of tabulate conductor pattern 151 provided on tabulate main body 111, and which is nested with positive connector 1. Moreover, individual conductor pattern 151 is located within main body 111, and includes accommodating terminal 153 which is engaged with protruded terminal 53 of positive connector 1 (i.e., pairing terminal), and rear end 158 which extends towards outside main body 111 and is connected with terminal connecting part 193 provided on surface 191*a* of second substrate 191. The face of rear end 158 on the side of second substrate 191 is more distant from surface 191*a* of second substrate 191 than the face of main body 111 on the side of second substrate 191. Rear end 158 is connected with terminal connecting part 193 through anisotropic conductive film 161 provided between its face on the side of second substrate 191 and terminal connecting part 193.

Therefore, in a state that negative connector 101 is carried onto surface 191*a* of second substrate 191, anisotropic conductive film 161 is located between rear end 158 and terminal connecting part 193, and can be connected with terminal connecting part 193 without deforming tabulate conductor pattern 151. Furthermore, when pressing anisotropic conductive film 161, since a part of the main body 111, which is closer to second substrate 191 than conductor pattern 151, function as spacers, the distance between rear end 158 and terminal connecting part 193 is kept fixed. Thus, anisotropic conductive film 161 will not be excessively compressed due to pressure, and is compressed at a fixed amount of compression, thus on-resistance of rear end 158 and terminal connecting part 193 is stable. Additionally, since anisotropic conductive film 161 will not be excessively compressed, the adhesive will not leak out from anisotropic conductive film 161 to pollute the environment.

Furthermore, the pairing terminal is the protruded terminal 53, accommodating terminal 153 is a tabulate part located in terminal accommodating opening 154, and includes the pair of contacting arm parts 153*a*, when protruded terminal 53, accommodated in the terminal accommodating opening, moves within terminal accommodating opening 154, the pair of contacting arm parts 153*a* elastically deforms to clamp protruded terminal 53. Therefore, contact between protruded terminal 53 and accommodating terminal 153 is reliably maintained.

Additionally, main body 111 includes enhanced layer 116 provided closer to the side of second substrate 191 than conductor pattern 151; positive connector 1 and negative connector 101 get engaged so that the front terminal of protruded terminal 53 accommodated in terminal accommodating opening 154 is more distant to front face 191*a* of second substrate 191 than the face of main body 111 on the side of second substrate 191. Therefore, even if the front terminal of protruded terminal 53 protrudes from the face of accommodating terminal 153 at the side of second substrate 191, the front terminal of protruded terminal 53 still will not be put against surface 191*a* of second substrate 191 to cause damage on such front face 191*a*, and will not unnecessarily conduct to wires and the like formed on front face 191*a*.

Moreover, there is also provided with tabulate enhanced frame layer 118 provided on the opposite side of second substrate 191 of conductor pattern 151, transverse frame part 118*a* of enhanced frame layer 118, which covers the opposite side of second substrate 191 of rear end 158. The face of enhanced frame 18 on the opposite side of second substrate 191 becomes the pressed face, and it bears pressure force for pressing force-exerting part of anisotropic conductive film 161. Therefore, pressure force is uniformly applied onto anisotropic conductive film 161.

Figure 7:
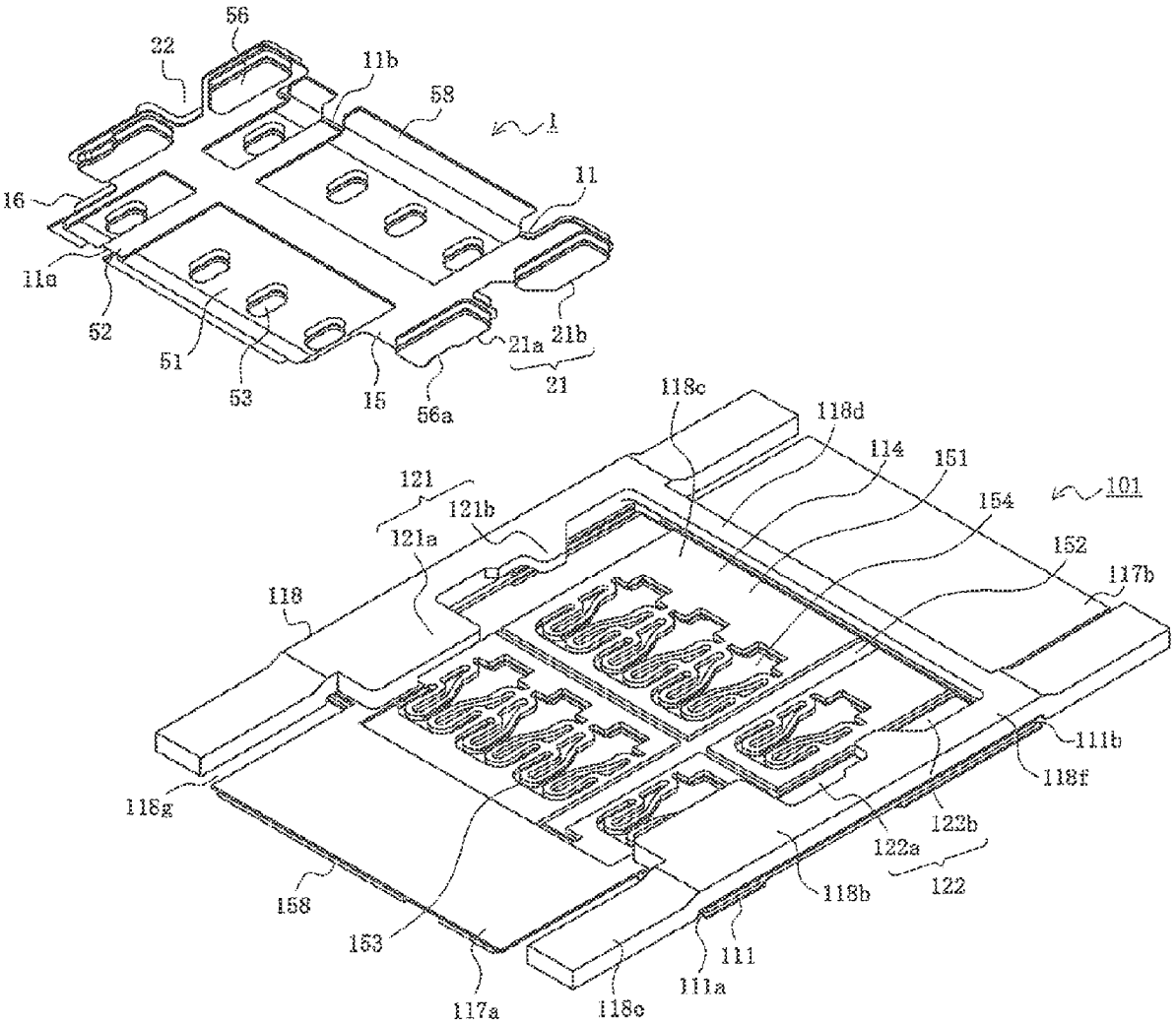
FIG. 7 is a perspective view showing the state when a nesting face of a positive connector is obliquely opposite a nesting face of a negative connector in an embodiment of the Present Disclosure.

Referring to FIG. 7, a second embodiment of the Present Disclosure will be explained. Parts having same structure as first embodiment are allocated with same reference numbers, and detailed explanation thereof is omitted. Furthermore, as for the same operations and same effects with the first embodiment, detailed explanation thereof is also omitted.

In this embodiment, enhanced frame layer 118 of negative connector 101 includes a pair of longitudinal frame part 118*b*, but not transverse frame part 118*a*. Therefore, a part corresponding to rear end 158 of conductor pattern 151 is peristome 118*g*. Moreover, left and right longitudinal frame parts 118*b* are connected by connecting stick 118*d* which extends in width direction of negative connector 101. In addition, as shown, although only one of connecting stick 118*d* is arranged at a position adjacent to back end 111*b* of main body 111, connecting stick 118*d* can be added at a position adjacent to front end 111*a* of main body 111. Therefore, connecting opening 118*c* is delimited at three directions by the pair of longitudinal frame parts 118*b* and one connecting stick 118*d*, or delimited at four directions by the pair of longitudinal frame parts 118*b* and the pair of connecting sticks 118*d*. In addition, above rear end 158 of conductor pattern 151 (direction to side of nesting face), there is no connecting stick 118*d*, and connecting stick 118*d* is arranged at a position closer to the center of front-back direction than rear end 158.

Furthermore, the front and back ends of longitudinal frame part 118*b* descend further than the other portions (i.e., enhanced body 118*f*); i.e., they become a supporting leg 118*e* closer to mounting face of negative connector 101. Therefore, in a side view, enhanced body 118*f* and supporting legs 118*e* on both sides are all extended parallel to mounting face of negative connector 101. Enhanced body 118*f* is more distant to the mounting face of negative connector 101 than supporting leg 118*e*. The connecting part between enhanced body 118*f* and supporting leg 118*e* is bent into a crank shape.

Additionally, the face of supporting leg 118*e* on the side of second substrate 191 and the face of enhanced layer 116 on the side of second substrate 191 are almost in the same plane. Therefore, when negative connector 101 is carried onto surface 191*a* of second substrate 191 so that face of enhanced layer 116 on the side of second substrate 191 is put against a surface of second substrate 191, face of supporting leg 118*e* on the side of second substrate 191 is also put against surface 191*a* of second substrate 191.

Moreover, rear end 158 of conductor pattern 151 and transverse frame part 117*a* of cover film 117 are arranged between the left and right supporting legs 118*e*, and the face of the transverse frame part 117*a* on the side of nesting face is not covered by enhanced frame layer 118 to be exposed. In addition, since structures of other aspects of negative connector 101 are the same with the first embodiment, descriptions thereof are omitted. Furthermore, since structure of positive connector 1 is the same with the first embodiment, descriptions thereof are omitted.

Figure 8:
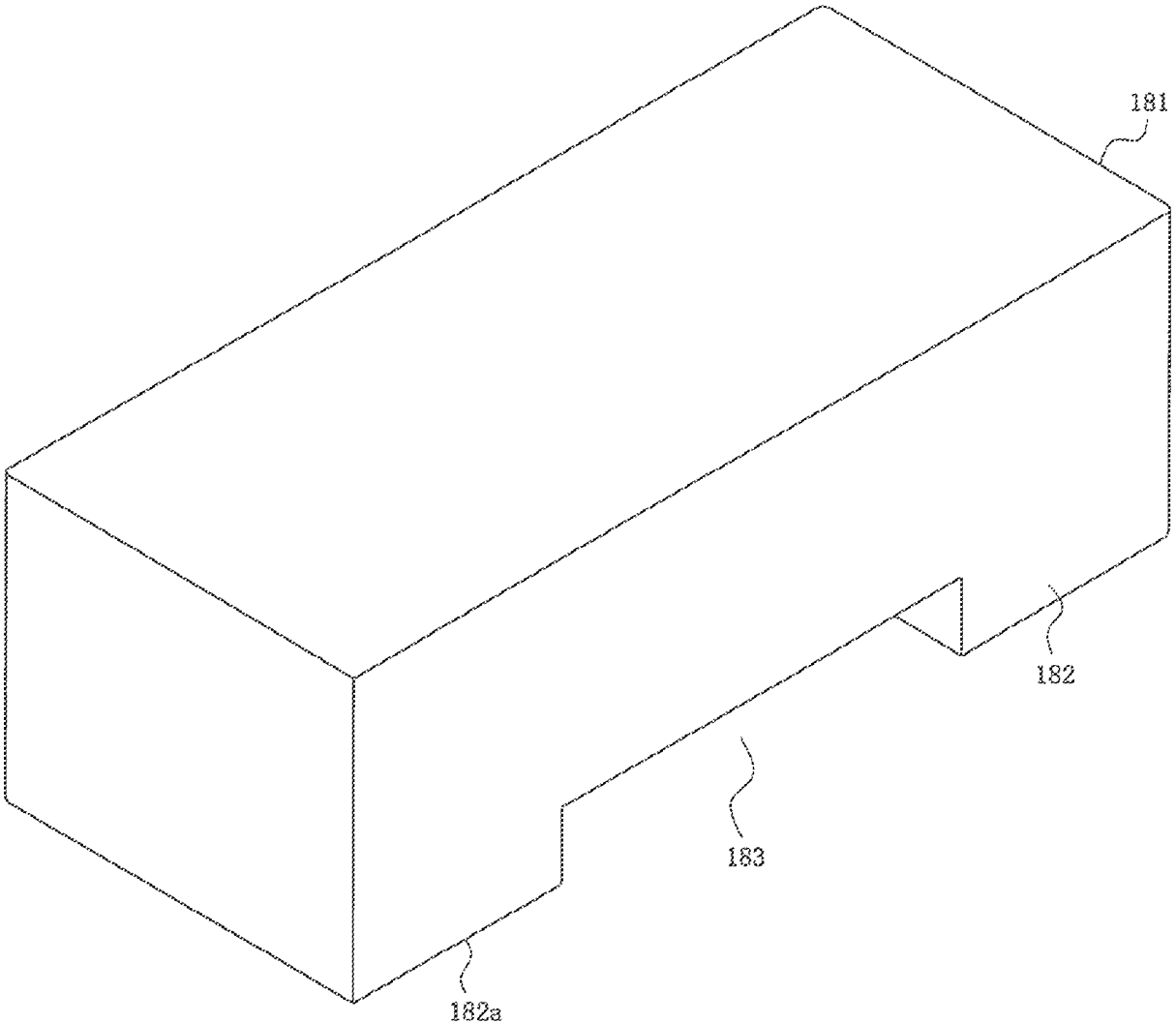
FIG. 8 is a perspective view showing a pressure head of a heat press device used during surface mounting of the negative connector of FIG. 7.
Figure 9:
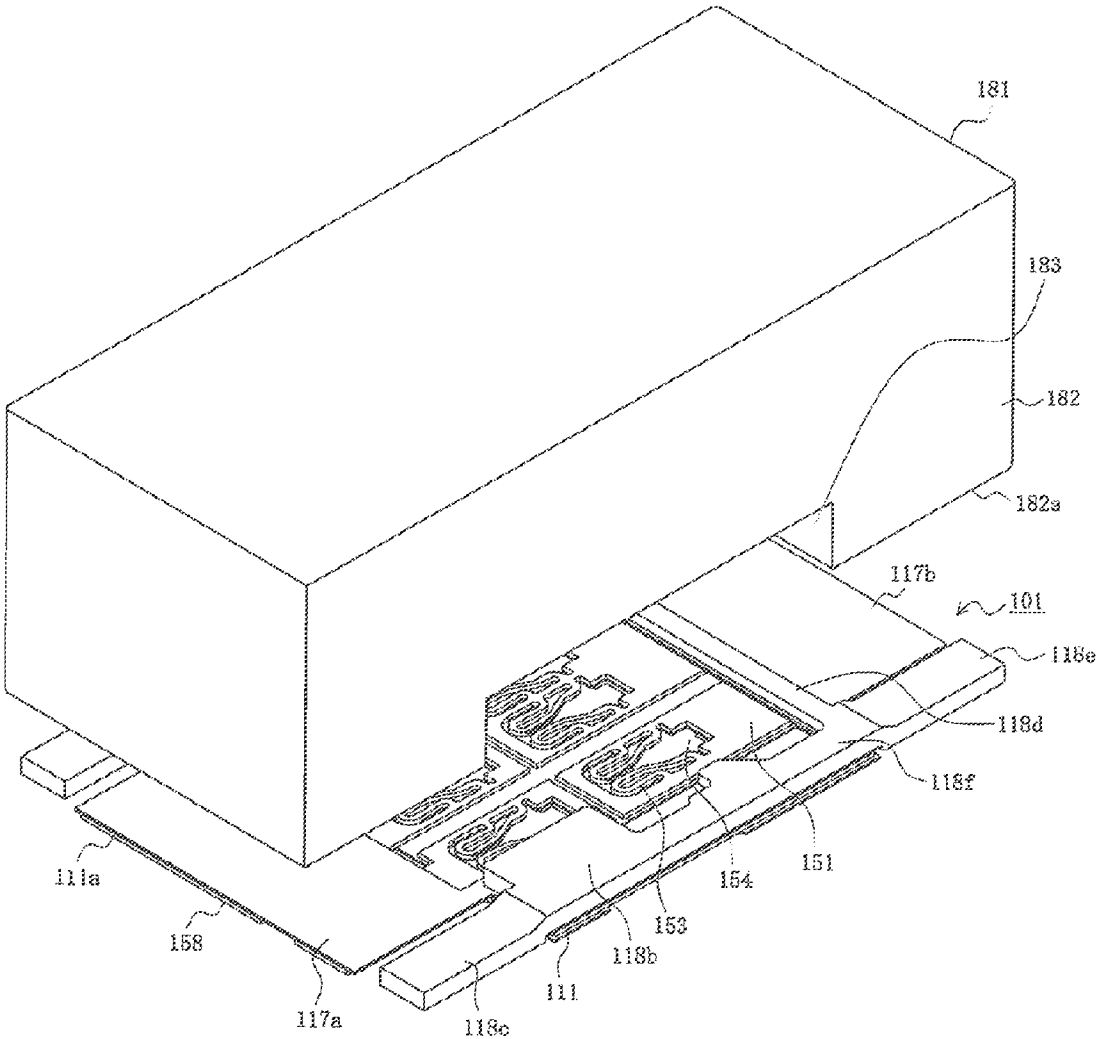
FIG. 9 is a first perspective view showing the surface mounting process of the negative connector of FIG. 7.
Figure 10:
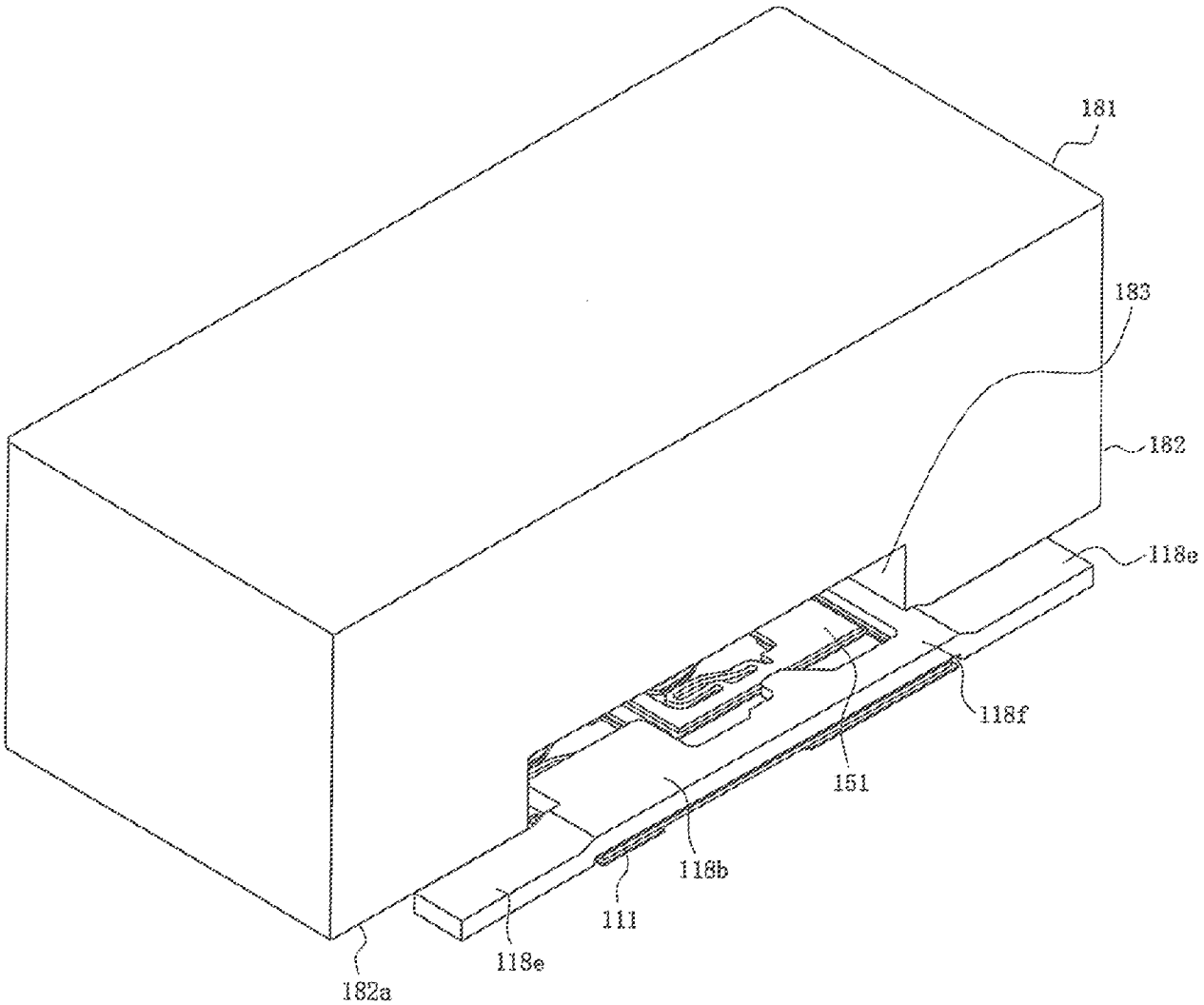
FIG. 10 is a second perspective view showing the surface mounting process of the negative connector of FIG. 7.
Figure 11:
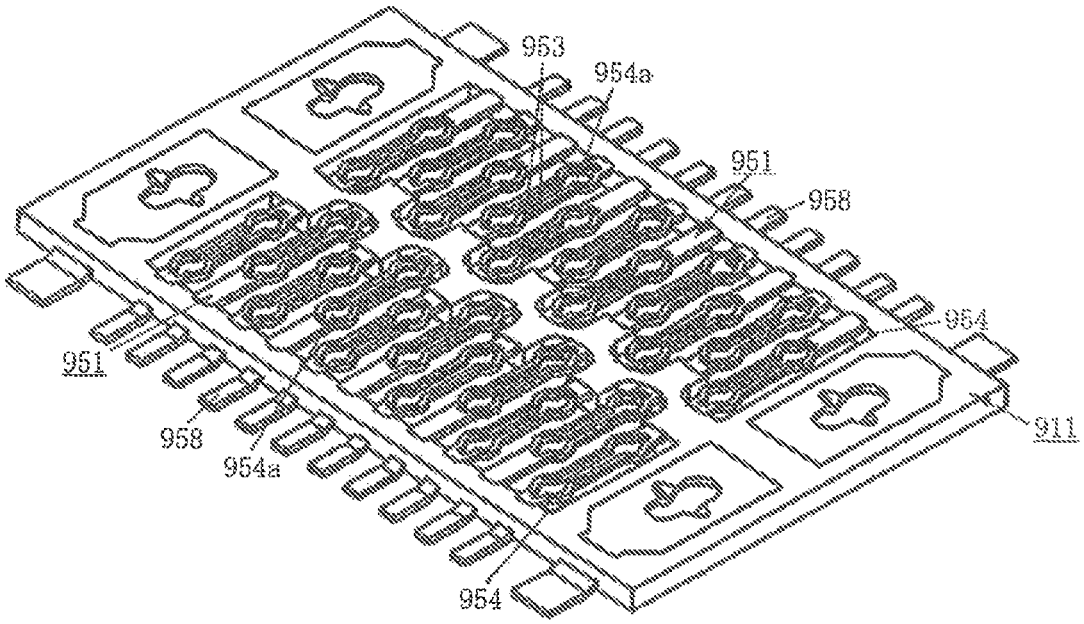
Prior art FIG. 11
FIG. 11 is a perspective view of a conventional connector.

FIGS. 8-10 illustrate a method of mounting negative connector 101 surface in this embodiment on second substrate 191. In this embodiment, when negative connector 101 is surface-mounted onto second substrate 191, pressure head 181 as shown in FIG. 8 is used to heat and press anisotropic conductive film 161 located between rear end 158 and terminal connecting part 193. In addition, here, for heating device driving heat press device of pressure head 181 and heating pressure head 181, for purpose of convenience, illustration and description are omitted.

Although pressure head 181 almost has an oblong shape, both ends in a direction of long side of a portion of it (specifically, the bottom surface) are provided with a pair of pressing bulge 182 formed as protruding downwardly. Moreover, bottom surface of pressing bulge 182 is against to transverse frame part 117*a* of cover film 117 of negative connector 101, to become a pressed flat pressing against face 182*a*. In addition, portion between the pair of pressing bulge 182 becomes a relatively upwardly recessed contrast concave 183.

The width of the bottom surface of pressure head 181 (i.e., size in width direction of pressing against face 182*a*) is shorter than interval between left and right supporting legs 118*e* of negative connector 101, and is set to be comparable to size in width direction of transverse frame part 117*a* of cover film 117. Furthermore, the length of contrast concave 183 is longer than the length of enhanced body 118*f* of negative connector 101. Thus, pressure head 181 can press transverse frame part 117*a* of cover film 117 and rear end 158 of conductor pattern 151 without pressing enhanced frame layer 118 of negative connector 101. Moreover, when negative connector 101 is surface-mounted onto second substrate 191, similar to the first embodiment, in a state that anisotropic conductive film 161 is located between rear end 158 and terminal connecting part 193, negative connector 101 is loaded onto a predetermined position on surface 191*a* of second substrate 191.

Then, as shown in FIG. 9, the position and posture of pressure head 181 or second substrate 191 is controlled, pressing against face 182*a* of each pressing bulge 182 into an opposite-arranged state with transverse frame part 117*a* of corresponding cover film 117 of negative connector 101. In addition, in FIGS. 9-10, for purpose of convenience, illustration of second substrate 191 is omitted.

Then, the heat press device (not illustrated) commences, forcing pressure head 181 to descend, i.e., moves towards second substrate 191, as shown in FIG. 10, forcing individual pressing bulge 182 to enter into peristome 118*g* of enhanced frame layer 118, and pressing against face 182*a* to against transverse frame part 117*a* of corresponding cover film 117 of negative connector 101, pushing transverse frame part 117*a* to second substrate 191. In addition, pressure head 181 is heated by heating device. Thus, since anisotropic conductive film 161 is heated and pressed through transverse frame part 117*a* of cover film 117, adhering rear end 158 and terminal connecting part 193 and making them conductive.

In this embodiment, pressing against face 182*a* of pressure head 181 is only put against and pushes transverse frame part 117*a* of cover film 117 on anisotropic conductive film 161, without pushing other parts of negative connector 101 such as enhanced frame layer 118. Anisotropic conductive film 161 is located between rear end 158 and terminal connecting part 193. Therefore, anisotropic conductive film 161 can be pressed with high pressure force, without raising pushing force exerted by pressure head 181. Furthermore, since the heat of heated pressure head 181 will not be delivered to other parts of negative connector 101 such as enhanced frame layer 118, it becomes possible to efficiently heat anisotropic conductive film 161. In addition, as for other structures and operations of surface-mounting on second substrate 191 of negative connector 101, since they are the same with the first embodiment, descriptions thereof are omitted.

Furthermore, in this embodiment, although a case that rear end 58 of positive connector 1 is the part connected with terminal connecting part formed on surface of first substrate by means such as welding is described, however, similar to rear end 158 of negative connector 101, changes can be made so that connection is made by anisotropic conductive film 161. Additionally, for operation of nesting positive connector 1 and negative connector 101, since it is the same with the first embodiment, descriptions thereof are omitted.

In this way, in this embodiment, there is also provided a tabulate enhanced frame layer 118 arranged at opposite side of second substrate 191 of conductor pattern 151. Enhanced frame layer 118 includes a peristome 118*g* corresponding to rear end 158, so that pressing bulge 182 of pressure head 181 of pressing anisotropic conductive film 161 can enter into peristome 118*g*. Therefore, anisotropic conductive film 161 can be pressed with high pressure force, without raising pushing force exerted by pressure head 181. Furthermore, since heat of heated pressure head 181 will not be delivered to other parts of negative connector 101 such as enhanced frame layer 118, it becomes possible to efficiently heat anisotropic conductive film 161. In addition, as for effects of other aspects, since they are the same with the first embodiment, descriptions thereof are omitted.

While a preferred embodiment of the Present Disclosure is shown and described, it is envisioned that those skilled in the art may devise various modifications without departing from the spirit and scope of the foregoing Description and the appended Claims.

What is claimed is:

1. A connector, the connector comprising:

a tabulate main body; and a plurality of tabulate conductors provided on the main body, nested with a pairing connector, each conductor including a tabulate terminal located in the main body and engaged with a pairing terminal of the pairing connector, and a rear end outwardly extended to the main body and connected to a terminal connecting part provided on the surface of a mounting part, the tabulate terminal being a tabulate part located in a terminal accommodating opening and including a pair of contacting arm parts, the pairing terminal being a protruded terminal;

wherein:

a face of the rear end on the side of the mounting part is more distant to the surface of the mounting part than a face of the main body on the side of the mounting part, the rear end being connected to the terminal connecting part through an anisotropic conductive film provided between its face on the side of the mounting part and the terminal connecting part; and when the protruded terminal moves within the terminal accommodating opening, the pair of contacting arm parts elastically deforms to clamp the protruded terminal.

2. The connector of claim 1, wherein the connector further includes a tabulate framework provided on the conductor at the opposite side of the mounting part, a portion of the framework covering the rear end on the opposite side of the mounting part, a face of the framework on the opposite side of the mounting part becomes a pressured face bearing the pressure force of a force-exerting part, the force-exerting part is used to exert pressure on the anisotropic conductive film.

3. The connector of claim 1, wherein the connector further includes a tabulate framework provided on the conductor at the opposite side of the mounting part, the framework including a peristome corresponding to the rear end, so that a portion of a force-exerting part exerting pressure on the anisotropic conductive film can enter into the peristome, whereby it is possible to uniformly push the anisotropic conductive film, and to connect the rear ends of the plurality of conductors to wires of the substrate.

4. The connector of claim 1, wherein the connector further includes a tabulate framework provided on the conductor at the opposite side of the mounting part, a portion of the framework covering the rear end on the opposite side of the mounting part, a face of the framework on the opposite side of the mounting part becomes a pressured face bearing the pressure force of a force-exerting part, the force-exerting part is used to exert pressure on the anisotropic conductive film.

5. The connector of claim 1, wherein the connector further includes a tabulate framework provided on the conductor at the opposite side of the mounting part, the framework including a peristome corresponding to the rear end, so that a portion of a force-exerting part exerting pressure on the anisotropic conductive film can enter into the peristome, whereby it is possible to uniformly push the anisotropic conductive film, and to connect the rear ends of the plurality of conductors to wires of the substrate.

6. The connector of claim 1, wherein the main body includes an enhanced layer provided on the conductor at the side of mounting part.

7. The connector of claim 6, wherein the pairing connector is nested within the connector, a front terminal of the protruded terminal is accommodated in the terminal accommodating opening more distant to the surface of the mounting part than a face of the main body on the side of the mounting part.

8. The connector of claim 7, wherein the connector further includes a tabulate framework provided on the conductor at the opposite side of the mounting part, a portion of the framework covering the rear end on the opposite side of the mounting part, a face of the framework on the opposite side of the mounting part becomes a pressured face bearing the pressure force of a force-exerting part, the force-exerting part is used to exert pressure on the anisotropic conductive film.

9. The connector of claim 7, wherein the connector further includes a tabulate framework provided on the conductor at the opposite side of the mounting part, the framework including a peristome corresponding to the rear end, so that a portion of a force-exerting part exerting pressure on the anisotropic conductive film can enter into the peristome, whereby it is possible to uniformly push the anisotropic conductive film, and to connect the rear ends of the plurality of conductors to wires of the substrate.

* * * * *